US005996384A

United States Patent [19]

Steeper et al.

[11] Patent Number: 5,996,384

[45] Date of Patent: Dec. 7, 1999

[54] HOT FLAT ROLLING MILL STAND AND CONTROL METHOD AND APPARATUS THEREFOR

[75] Inventors: Michael Steeper, Sheffield; Kevin Oliver, Dorset, both of United Kingdom

[73] Assignee: Kvaerner Technology & Research Ltd., Sheffield, United Kingdom

[21] Appl. No.: 09/119,581

[22] Filed: Jul. 21, 1998

[30] Foreign Application Priority Data

Sep. 11, 1997 [GB] United Kingdom ..... 9719361

[51] Int. Cl.[6] ..... B21C 51/00

[52] U.S. Cl. ..... 72/37; 72/8.3; 72/11.1; 348/88; 382/141

[58] Field of Search ..... 72/7.4, 8.3, 11.1, 72/11.7, 12.7, 37, 229, 240; 348/88, 92, 94, 95, 128; 356/375, 376, 384; 250/559.08, 559.29; 702/94; 382/141

[56] References Cited

U.S. PATENT DOCUMENTS

| | | | |
|---|---|---|---|
| 4,099,244 | 7/1978 | Galanis et al. . | |
| 4,570,472 | 2/1986 | Kuwano . | |
| 5,305,099 | 4/1994 | Morcos | 348/88 |
| 5,724,093 | 3/1998 | Parenti | 348/92 |
| 5,771,732 | 6/1998 | Kramer et al. | 72/229 |

FOREIGN PATENT DOCUMENTS

| | | | |
|---|---|---|---|
| 38 37 101 | 5/1990 | Germany . | |
| 197 04 337 | 8/1998 | Germany | 72/229 |
| 59-104206 | 6/1984 | Japan | 72/11.7 |
| 63-63515 | 3/1988 | Japan | 72/11.1 |
| 63-63518 | 3/1988 | Japan | 72/11.1 |

*Primary Examiner*—Joseph J. Hail, III
*Assistant Examiner*—Ed Tolan
*Attorney, Agent, or Firm*—Oliff & Berridge, PLC

[57] ABSTRACT

The invention relates to a rolling mill stand including an automatic strip steering and control system, comprising at least two rolls arranged alongside each other and permitting strip to pass between them from an entry side to an exit side, and comprising roll actuating means for adjusting the position of the rolls, wherein the system comprises at least one camera means for viewing the strip on the entry side of the mill and measuring the axial alignment thereof to produce a camera measurement signal which is used as an input signal to control the roll actuating means which acts on the roll to adjust the roll gap and/or tilt angle of the roll. First and second camera means are provided for viewing the strip on the exit and entry sides of the mill. A pair of actuating means are provided one arranged on each side of the rolls. The actuating means may be hydraulic roll gap cylinders. The center line deviation of the strip is measured by a CCD camera or a similar device, using signal processing to provide a measurement and image of the width of the strip and an error signal is then passed through a control system which generates a differential roll gap correction.

14 Claims, 4 Drawing Sheets

HOT FLAT ROLLING MILL STAND AND CONTROL METHOD AND APPARATUS THEREFOR

FIELD OF THE INVENTION

The present invention relates to an automatic steering control system method and apparatus therefor and in particular for all hot mill types, reversing and non-reversing, for steel and other metals and most particularly for steckel mills.

BACKGROUND OF THE INVENTION

Steering performance is well known to be critical in rolling mills such as steckel mills. A steckel mill equipped with hydraulic gap control has the potential for automatic steering control through differential cylinder-adjustment. Conventionally, steckel operators steer the mill by watching for deviations of the strip running line from the centre line of the mill, and adjusting the differential roll gap to counteract this. However, this method can lead to over-steering and as a result the strip carries not only a high risk of cobbles, but also other difficulties, leading to long outages in clearing the line afterwards.

The conventional method of automatic steering is to apply a differential roll gap correction according to a measured differential load. The effectiveness of this method depends on the source of error. If there is a difference in temperature (and thus resistance to deformation) across the stock it generally works well, acting to keep elongation equal at the two edges. The bar then remains straight. If the stock has a wedge profile, with one side larger than the other, however, the system will tend to equalise the edge thicknesses but in doing so produces a cambered bar. A steering system based on load difference is thus limited in performance by an inability to discriminate between these two sources of error.

It is an objective of the invention to provide effective control, thus leading to benefits in mill stability and dimensional variability, particularly in eliminating the problems associated with the rolling of wedge shaped product.

SUMMARY OF THE INVENTION

According to the invention there is provided a rolling mill stand including an automatic strip steering and control system, said rolling mill stand comprising at least first and second rolls arranged alongside each other and permitting strip to pass between them from an entry side to an exit side of the mill, said rolling mill stand also comprising at least one roll actuating means for adjusting the position of at least one of the rolls, wherein the system comprises at least one camera means for viewing the strip on the entry side of the mill and measuring the axial alignment thereof and which produces a camera measurement signal which is used as an input signal to control the said at least one roll actuating means which acts on the roll to adjust the roll gap and/or tilt angle of the roll.

In a further aspect of the invention an automatic strip steering and control system for a rolling mill stand described above is provided as is a method of rolling hot metal as described above.

Preferably first and second camera means are provided for viewing the strip on the exit and entry sides of the mill.

Preferably a pair of actuating means are provided one arranged on each side of the first or second rolls. The actuating means may provided as hydraulic roll gap cylinders.

According to the invention, the centre line deviation of the strip is measured by a CCD camera or a similar device, using signal processing to provide a measurement and image of the width of the strip. The centre line deviation error signal is then passed through a control system which generates a differential roll gap correction.

Preferably the differential roll gap correction is applied by a differential extension of hydraulic roll gap control cylinders.

Preferably the control system is a first order filter and a proportional plus integral controller.

Preferably the CCD cameras operate in the infra-red mode if the strip temperature is above approximately 750 deg C.

Preferably since some grades of product and particularly the ends may have temperatures below 750 deg C, an alternative backlit mode of operation is provided. Preferably the backlights are mounted below the roller tables.

Preferably two camera systems and their associated controllers are used on a reversing mill, one looking along the rolling line in each direction. Preferably in a two-camera configuration, the control action is based on a combination of error signals from each side of the mill, with the entry side predominating.

It will be readily apparent that the use of a camera system or similar device to measure the centre line position of the strip and the use of this signal to apply an automatic correction overcomes the problems described associated with manual steering and with automatic steering based on a differential load measurement.

BRIEF DESCRIPTION OF THE DRAWINGS

There now follows a more detailed description of a specific embodiment of the method and apparatus according to the invention with the help of the attached drawings in which.

DETAILED DESCRIPTION OF THE PREFERRED EMBODIMENTS

Figure 1:
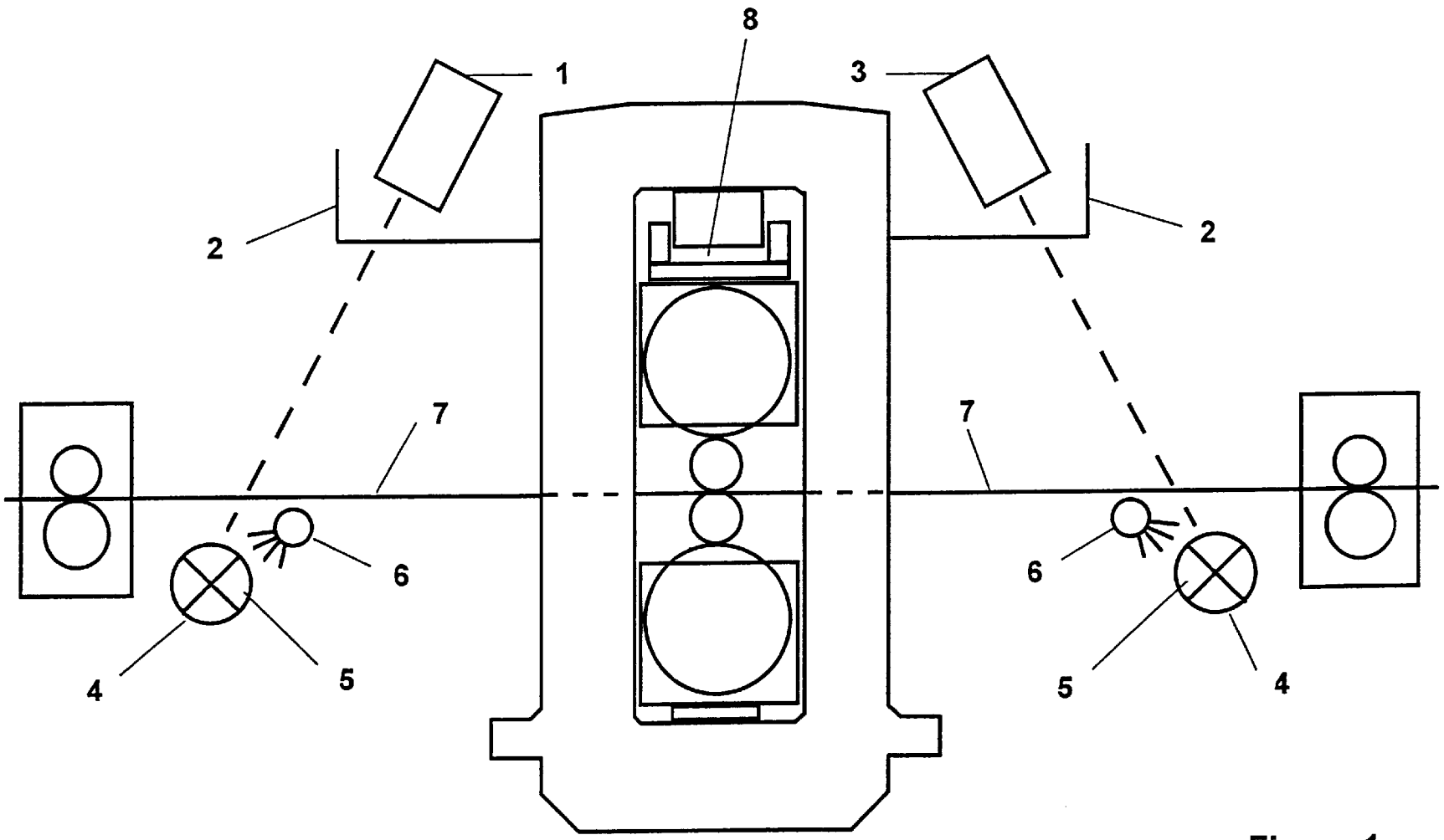
FIG. 1 is a side view of the apparatus according to the embodiment of the invention.

FIG. 1 shows one embodiment of the apparatus which comprises a charged coupled device (CCD) camer a (1) employed in a monoscopic configuration. This camera (1) mounted on the mill centre line outboard of the screw-down platform (2) and looking down towards the strip (7) has a similar counterpart on the opposite side of the mill (3). The underside of the steel strip is illuminated by a backlight (4) which provides a shadow image for the CCD cameras. Both backlight systems and camera systems are protected from the environment both mechanically and by the provision of cooling water and air (5) and (6). The cameras and their associated signal processing provide a signal describing the deviation of the strip centre line from the mill centre line at mill entry and separately at mill exit. In this embodiment, the automatic gauge control system of the mill applies a differential position control correction to the hydraulic screw-down cylinders (8) and hence a differential gap correction to the roll bite to compensate the strip deviation. In this embodiment, the controller is a proportional plus integral feedback controller configured so as to close the gap at the side of the mill towards which the strip is moving and to open the gap at the opposite side.

Figure 2:
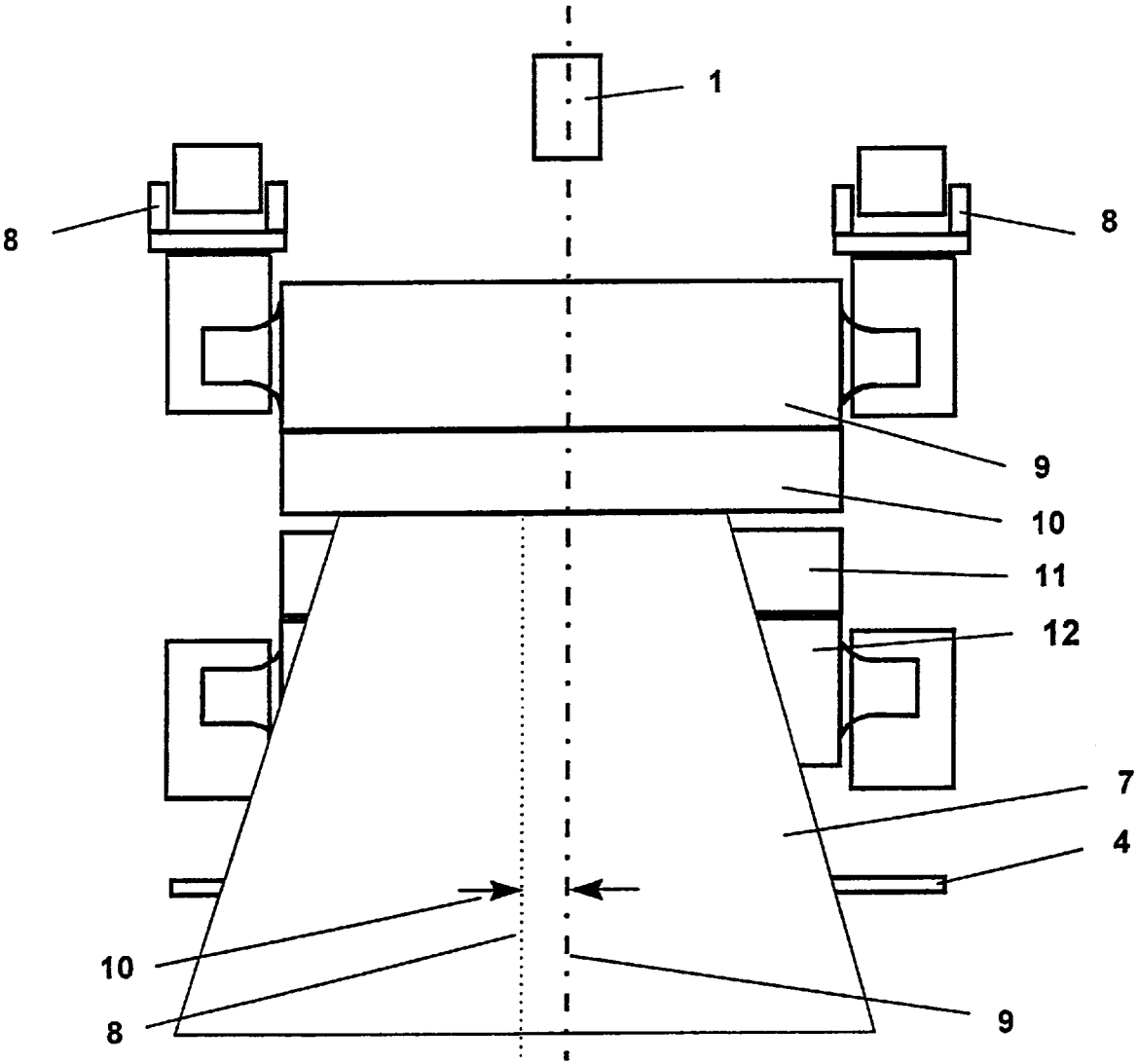
FIG. 2 is an end view of the apparatus according to the embodiment of the invention.

FIG. 2 shows another elevation of the same embodiment. The CCD camera is shown mounted on the mill centre line (1) and the strip (7) passes below it through the rolls (9), (10), (11) and (12). The camera receives radiation either directly from the strip (7) (infra red) or from the back light (visible spectrum) (4) according to the mode of use. In either case the camera and its signal processing electronics can measure the strip centre line (8) position on a continuous basis. The difference between this centre line position and the physical datum corresponding to the mechanical mill centre line (9) is treated as an error signal (10) and passed through the P+I controller to generate a differential position signal to the hydraulic screwdown cylinders (8). The differential extension of these cylinders (8) is transmitted through the rolls (9) and (10) and causes the roll gap to narrow at the strip edge which is moving outwards due to the centre line deviation. This provides a correcting force to bring the strip back on the mechanical centre line of the mill (9).

Figure 3:
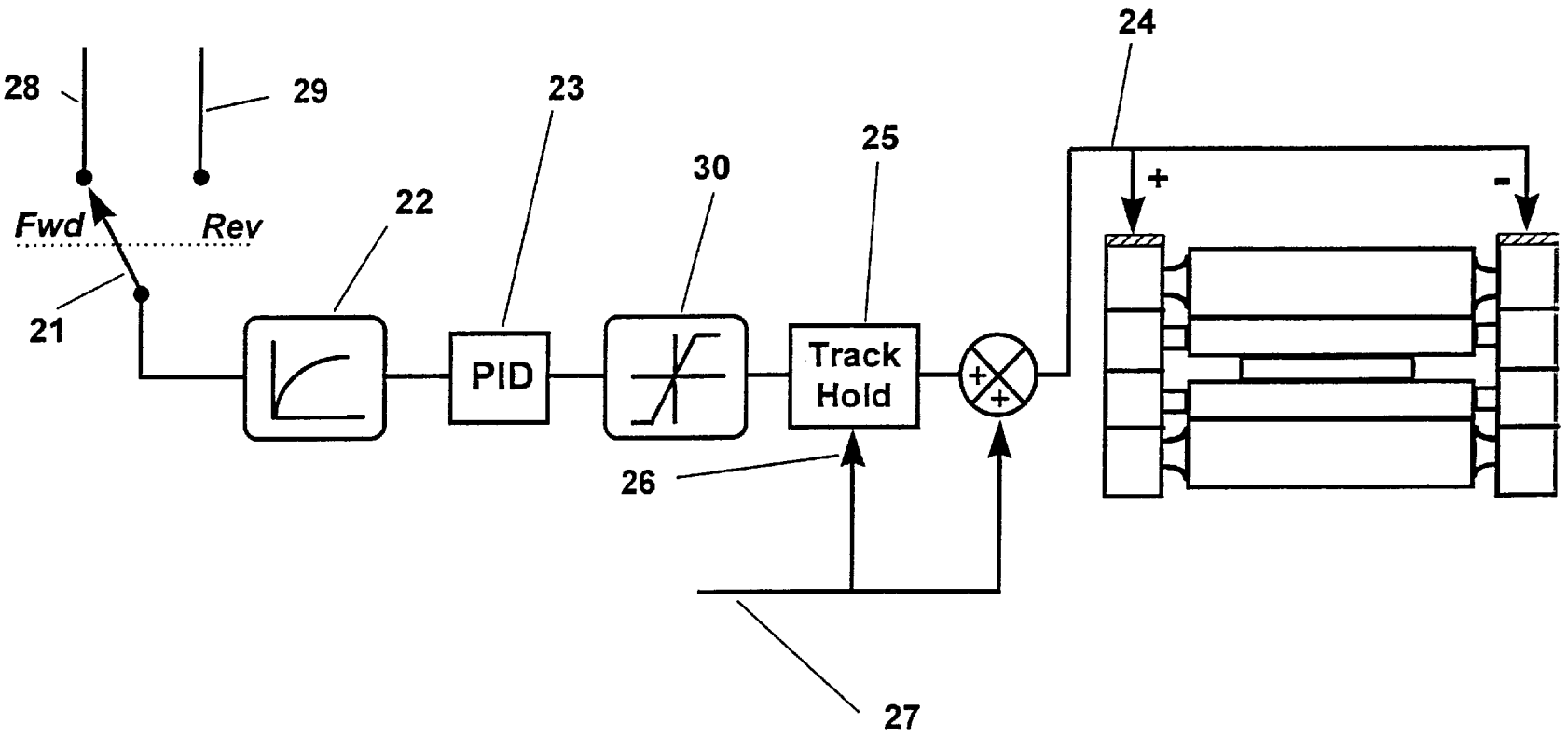
FIG. 3 shows the control system in schematic form.

A specific embodiment of the control system is shown in FIG. 3. The centre line deviation signal source is switched according to the direction of rolling (21) so that the controller always acts upon the deviation signal from the entry side of the mill (28) or (29). The signal is passed through a first order filter (22) to smooth out transient spikes which might result from momentary obscuring of the camera by fumes or steam. The signal is then processed by a PID controller (23) and a limiter (30) to generate a signal which is passed to the hydraulic screwdown cylinders (24) as a differential position correction. This circuit also incorporates a track hold (25) feature which freezes (26) the camera-based steer correction whenever the manual steer reference (27) is also added to the differential position correction. This feature is useful during the commissioning of the system because it prevents any tendency for the manual correction made by the operator to interfere with the automatic control. If a strict manual correction is applied, it can be optionally retained or cancelled on mill reversal. More complex variants on this control may be implemented whereby simultaneous control using differential gains is applied through the cameras at both the entry (28) and exit (29) side. Further options include a gain dependency on the inverse speed of the mill. This feature is useful where a tendency for the strip to slew at tail out from a steckel drum is present.

Figure 4:
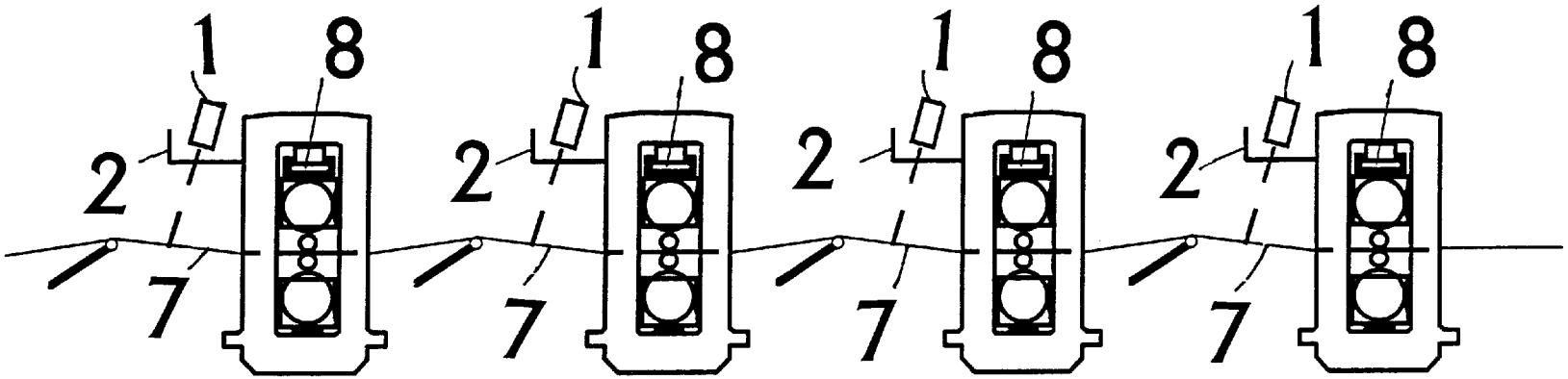
FIG. 4 shows an alternative tandem mill embodiment of the invention.

FIG. 4 shows a side elevation of a tandem mill embodiment of the invention. Cameras (1) are located on the screwdown platforms (2) on the mill centre line looking down towards the strip (7) on the entry side of each mill stand. Backlights are not shown in this embodiment because the strip temperature is sufficiently high for the cameras to work in infra-red mode. The cameras and their associated signal processing provide a signal describing the centre line deviation of the strip at the entry side of each stand. In this embodiment the control system applies a differential position signal to the hydraulic cylinders (8) to compensate for the centre line deviation. The controller may be as described above with reference to FIG. 3 or it may utilise the entry side signals from two or more of the stands simultaneously to calculate the best control action to apply to the hydraulic cylinders of each stand.

What is claimed is:

1. A rolling mill stand including an automatic strip steering and control system, said rolling mill stand comprising at least first and second rolls arranged alongside each other and permitting a strip to pass between them from an entry side to an exit side of the mill, said rolling mill stand also comprising at least one roll actuating means for adjusting the position of at least one of the rolls, wherein the system comprises a first camera means viewing the strip on the entry side of the mill and a second camera means viewing the strip on the exit side of the mill, the camera means measuring the axial alignments thereof and producing camera measurement signals which are used as input signals to control the at least one roll actuating means which acts on the roll to adjust the roll gap and/or tilt angle of the roll, the camera means being arranged on the center line of the mill.

2. A rolling mill according to claim 1, wherein the camera is a charged coupled device (CCD) camera employed in a monoscopic configuration.

3. A rolling mill according to claim 1, wherein a lighting means is provided on the opposite side of the strip to the at least one camera and which provides a shadow image which is measured by the said at least one camera.

4. A rolling mill according to claim 1, wherein the a signal processing stage is provided between the camera and the roll actuating means.

5. A rolling mill according to claim 4, wherein the signal processing stage includes a proportional plus integral feedback controller.

6. A rolling mill according to claim 4, wherein the signal processing stage is configured to open or close the gap between the first and second rolls on a first side of said rolls corresponding to the side of the strip which is moving off line in a direction towards said first side.

7. A rolling mill according to claim 1, wherein first and second roll actuating means are provided on each of the first and second sides of the rolling mill to adjust the roll gap between the rolls at the corresponding first and second sides of the rolls.

8. A rolling mill according to claim 4, wherein the signal processing stage is configured to close the gap between the first and second rolls on a first side of said rolls corresponding to the side of the strip which is moving off line in a direction towards said first side and/or to open the gap between the first and second rolls on a second side of said rolls corresponding to the side of the strip which is moving off line in a direction away from said second side.

9. A rolling mill according to claim 1, wherein the camera means is arranged so that it is able to measure the alignment of the strip on both the entry and the exit sides of the mill.

10. A rolling mill according to claim 1, wherein the rolling mill is a steckel steel mill.

11. A rolling mill according to claim 1, wherein the rolling mill is a tandem mill.

12. A rolling mill according to claim 1, wherein the camera and/or lighting means is provided with a coolant spray to prevent overheating.

13. A rolling mill according to claim 1, wherein the camera and/or lighting means is provided with a cleaning spray such as a jet of air to continuously or intermittently clean the camera and/or lighting means of debris or dust from the rolling process.

14. An automatic strip steering and control system for a rolling mill stand comprising at least first and second rolls arranged alongside each other and permitting a strip to pass between them from an entry side to an exit side of the mill, said rolling mill stand also comprising at least one roll actuating means for adjusting the position of at least one of the rolls, wherein the system comprises first camera means viewing the strip on the entry side of the mill and a second camera means viewing the strip on the exit side of the mill, the camera means measuring the axial alignments thereof and producing camera measurement signals which are used as input signals to control the at least one roll actuating means which acts on the roll to adjust the roll gap and/or tilt angle of the roll, the cameras being arranged on the center line of the mill.

* * * * *